US006659514B2

(12) United States Patent
Bass

(10) Patent No.: US 6,659,514 B2
(45) Date of Patent: Dec. 9, 2003

(54) SWINGING ELEVATOR HATCHWAY DOOR INTERLOCK

(75) Inventor: Patrick M. Bass, Hernando, MS (US)

(73) Assignee: Thyssen Elevator Capital Corp., Whittier, CA (US)

( * ) Notice: Subject to any disclaimer, the term of this patent is extended or adjusted under 35 U.S.C. 154(b) by 0 days.

(21) Appl. No.: 09/848,908

(22) Filed: May 4, 2001

(65) Prior Publication Data

US 2002/0163206 A1 Nov. 7, 2002

(51) Int. Cl.[7] ..... E05C 19/10

(52) U.S. Cl. ..... 292/122; 292/203; 292/201; 292/DIG. 25; 187/335; 187/37; 187/331; 70/278.7

(58) Field of Search ..... 292/128, 122, 292/124, 102, 228, 203, 202, 341.16, 241.15, DIG. 25, 201; 70/96, 99, 100, 277, 278.7, 279.1, 282; 181/331, 335, 339, 342

(56) References Cited

U.S. PATENT DOCUMENTS

| | | | | | |
|---|---|---|---|---|---|
| 1,326,440 | A | * | 12/1919 | Chaudoir | 187/330 |
| 1,835,544 | A | * | 12/1931 | Werner | 187/280 |
| 2,180,825 | A | * | 11/1939 | Henricksen | 187/280 |
| 2,810,284 | A | * | 10/1957 | Wartian | 70/99 |
| 3,594,031 | A | * | 7/1971 | Ford | 292/140 |
| 3,625,312 | A | * | 12/1971 | Hutner | 187/280 |
| 4,483,420 | A | * | 11/1984 | Byrne | 187/280 |
| 4,840,254 | A | * | 6/1989 | Pearson et al. | 187/331 |
| 4,875,553 | A | * | 10/1989 | Smith et al. | 187/401 |
| 5,005,673 | A | * | 4/1991 | Rivera | 187/330 |
| 5,368,131 | A | * | 11/1994 | Yoshihiro | 187/301 |
| 5,377,785 | A | * | 1/1995 | Pearson | 187/308 |
| 5,386,886 | A | | 2/1995 | Kobayashi et al. | 187/335 |
| 5,507,365 | A | * | 4/1996 | Prudhomme | 187/331 |
| 5,518,282 | A | * | 5/1996 | Sawada | 292/252 |
| 5,823,026 | A | * | 10/1998 | Finke | 70/276 |
| 5,894,911 | A | * | 4/1999 | Bozorgzadeh et al. | 187/335 |
| 5,899,302 | A | * | 5/1999 | O'Donnell | 187/314 |
| 5,918,704 | A | * | 7/1999 | Chevilliard et al. | 187/335 |
| 6,220,396 | B1 | * | 4/2001 | Heath, III | 187/335 |
| 6,327,879 | B1 | * | 12/2001 | Malsom | 70/97 |
| 6,340,073 | B1 | * | 1/2002 | Lee et al. | 187/309 |
| 6,357,803 | B1 | * | 3/2002 | Lorek | 292/99 |

FOREIGN PATENT DOCUMENTS

| | | |
|---|---|---|
| DE | 1205671 | 11/1965 |

* cited by examiner

*Primary Examiner*—Robert J. Sandy
*Assistant Examiner*—Dinesh N Melwani
(74) *Attorney, Agent, or Firm*—White & Case, LLP

(57) ABSTRACT

An electromechanical interlock for a swinging elevator door is disclosed. The interlock comprises a pivotal hook member that may be attached to a swinging elevator door. The hook has a beak end and may pivot between a locked and an unlocked position. Disposed on the beak end is an electrical conductor. When the interlock is in the locked position, the beak end engages a lug and the conductor contacts electrical contacts to complete an electrical circuit. A solenoid pivots the hook from a locked position to an unlocked position. The electromechanical interlock may be adapted for use with sliding elevator doors as well as swinging doors.

10 Claims, 4 Drawing Sheets

SWINGING ELEVATOR HATCHWAY DOOR INTERLOCK

FIELD OF THE INVENTION

The present invention relates to elevator systems that employ swinging hatchway doors. In particular, the present invention provides an electromechanical interlock that locks and unlocks a swinging elevator hatchway door and provides a means for determining when the hatchway door is locked.

DESCRIPTION OF RELATED ART

Elevator systems typically employ hatchway doors and car doors. It is imperative that hatchway doors be locked at all times, unless an elevator car is located at the same landing area as the hatchway door. Moreover, before an elevator car leaves a landing area at which a hatchway door was opened, the elevator system must verify that the hatchway door is locked. Various interlock devices exist for use with sliding hatchway doors, however, there has been heretofore no true electromechanical interlock system (i.e. "a device that has two related interdependent functions, which are: (a) to prevent the operation of the driving machine by the normal operating device unless the hoistway door is locked in the closed position; and (b) to prevent the opening of the hoistway door from the landing side unless the car is within the landing zone and is either stopped or being stopped." (see ASME A-17.1b-1998 incorporated herein by reference)) for swinging hatchway doors.

SUMMARY OF THE INVENTION

The present invention provides a true electromechanical interlock for use with swinging hatchway doors that swing between opened and closed positions. In one embodiment, the interlock comprises a pivotal hook that is pivotally mounted on a swinging elevator hatchway door. The pivotal hook is preferably, but not necessarily, mounted on the interior surface (i.e. the shaft, or hoistway, facing surface) of the door. The pivotal hook protrudes in a generally perpendicular direction from the interior surface of the swinging hatchway door. The pivotal hook has a beak end and rotates between a locked and unlocked position. An electrical conductor is mounted on the beak end. A spring or other means biases the pivotal hook toward the locked position. The lug preferably, but not necessarily, has an inclined surface for slidably engaging the beak end when the door swings from the open position to the closed position. The lug also has a locking surface for engaging the beak end when the hook is in the locked position and an attempt to open the door is made. When the pivotal hook is in the locked position, the electrical conductor engages electrical contacts, which may be disposed on an electrical contact assembly, to close an electrical circuit. The closing of the electrical circuit indicates that the pivotal hook is in the locked position and thus, the door is locked closed. A solenoid having an extendable pin is mounted adjacent to the beak end of the pivotal hook so that when the solenoid is energized, the extendable pin extends and contacts the hook, thereby pivoting the pivotal hook from the locked position to the unlocked position. When the solenoid is not energized, the solenoid pin is retracted and the biasing means pivots the pivotal hook to the locked position when the hatchway door is in the closed position. The lug, electrical contact assembly, and solenoid may be mounted on a mounting plate, which in turn can be mounted in an elevator hoistway or on an elevator hatchway door jamb.

DETAILED DESCRIPTION OF THE INVENTION

Figure 1:
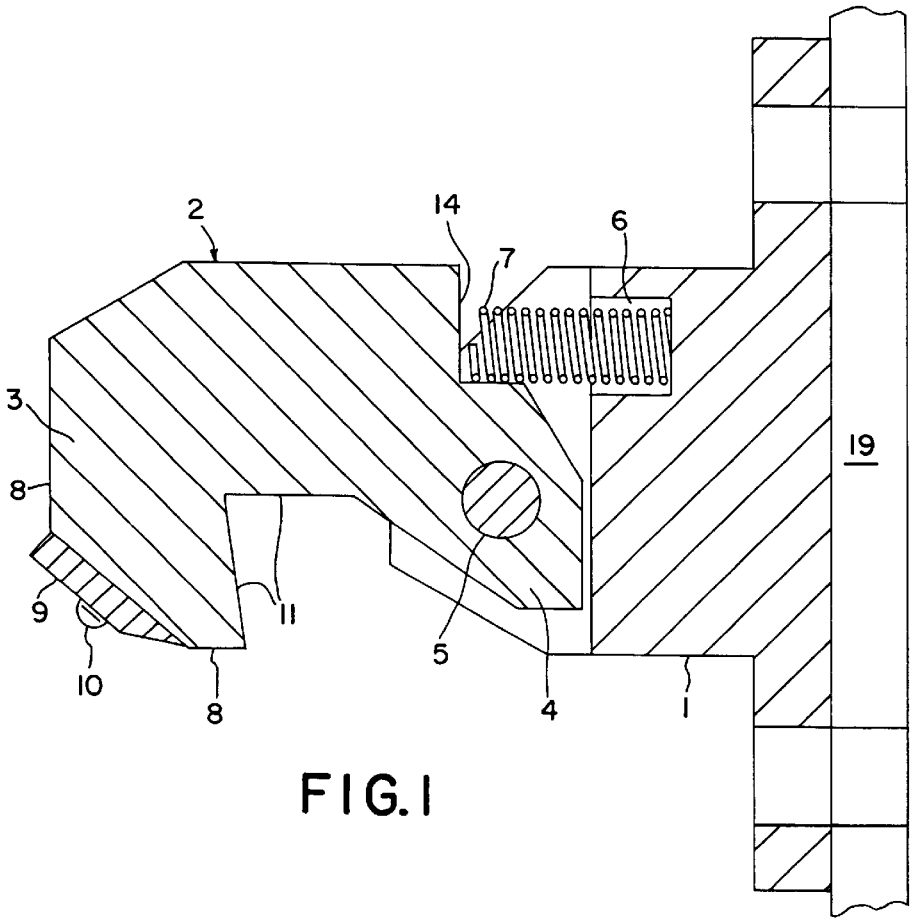
FIG. 1 depicts a pivotal interlock hook and mounting bracket for use with the present invention.
Figure 2:
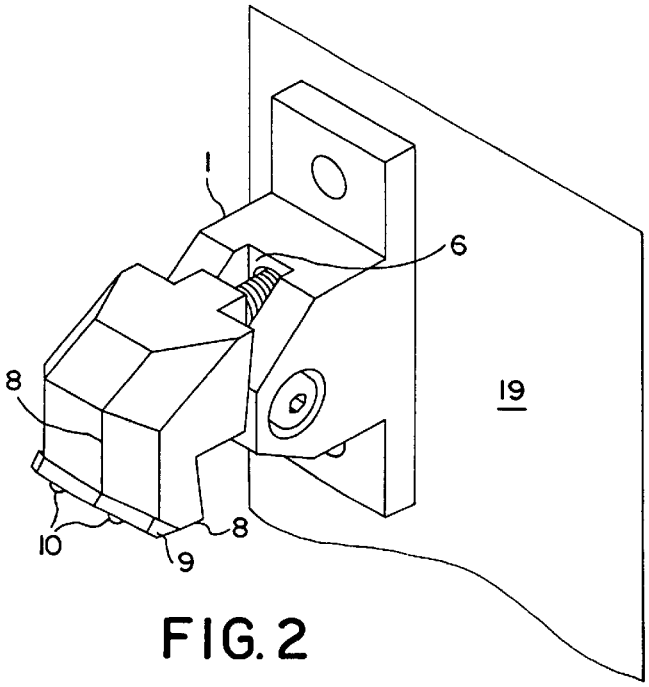
FIG. 2 is a perspective view of the pivotal hook depicted in FIG. 1.
Figure 2A:
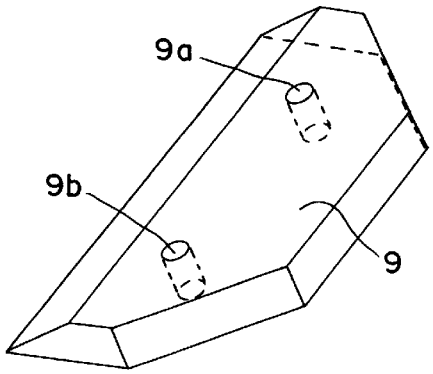
FIG. 2A is a perspective view of an electrical conductor that may be mounted on the pivotal hook.

As is shown in FIGS. 1 and 2, a bracket 1 is used to mount a pivotal hook 2 to a swinging elevator hatch way door 19. The pivotal hook 2 has a beak end 3 and a fulcrum end 4. The fulcrum end 4 is pivotally secured to the bracket 1 with a pin 5. The hook pivots about an axis of rotation that is created by the pin 5. The pivotal hook 2 may be manufactured from any suitable material, such as phenolic plastic. A spring 7, mounted in a slot 6 and abutting a shoulder 14, biases the hook in a counter-clockwise direction (as oriented in FIG. 1). The beak end 3 has an outboard surface 8, which may be comprised of several contiguous planar surfaces, as is shown in FIG. 1. An electrical conductor 9 (see also FIG. 2A) is disposed on the outboard surface 8 of the beak end 3. (See FIGS. 1 & 2). Brass pin escutcheons 10 may be disposed within two holes 9*a* and 9*b* provided on the conductor 9. The beak end 3 also has an inboard surface 11, which may also be comprised of several contiguous planar surfaces, as is shown in FIG. 1.

Figure 3:
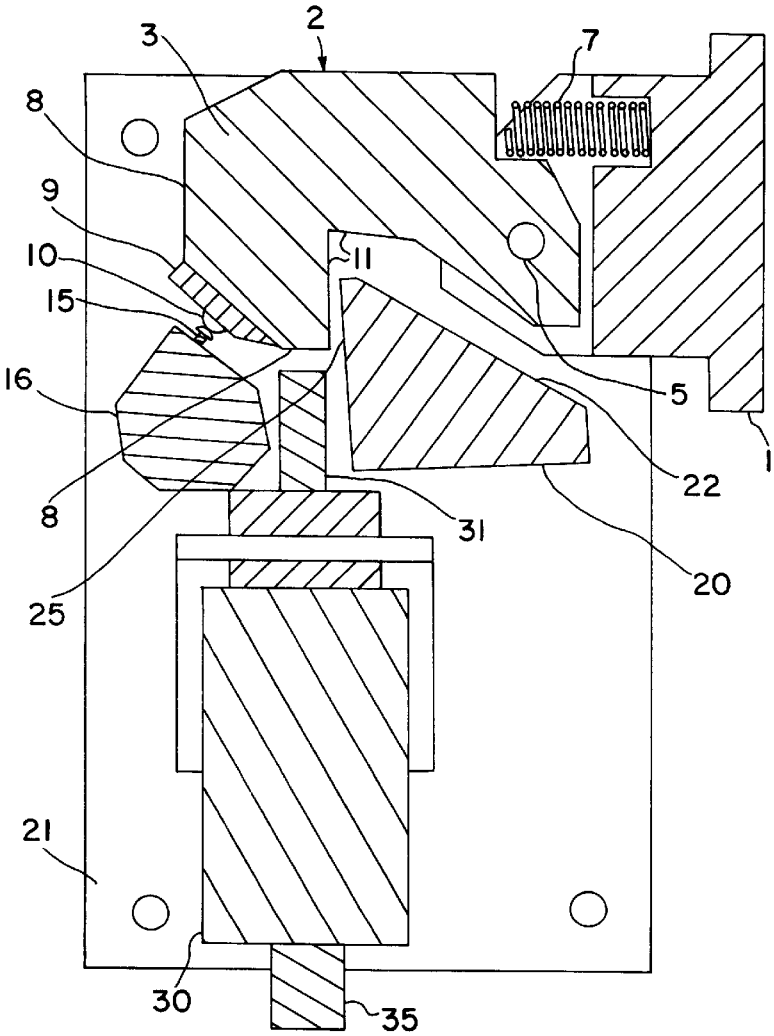
FIG. 3 depicts an electromechanical interlock according to the present invention wherein the interlock is in a locked position.

As is shown in FIG. 3, a lug 20 is mounted to a mounting plate 21, which in turn may be mounted to a door jamb or other suitable secure surface or structure. The lug 20 preferably has an inclined surface 22 for engaging the outboard surface 8 and conductor 9 on the beak end 3 when the elevator hatchway door swings from an open position to a closed position. In the embodiment depicted, the spring 7 abuts the shoulder 14 to bias the pivotal hook 2 in a counter-clockwise direction so that when the hatchway door swings closed the outboard surface 8 of the beak end 3 slides up the inclined surface 22 of the lug 20. After the outboard surface 8 slides past the inclined surface 22 of the lug 20, the pivotal hook 2 pivots to a locked position, as is shown in FIG. 3. If the hatchway door starts to swing toward an open position, the inboard surface 11 of the beak end 3 will engage a locking surface 25 of the lug 20, thereby preventing the door from swinging open. In the locked position, the brass pin escutcheons 10 on the conductor 9 engage electrical contacts 15 on an electrical contact assembly 16 (which can be either a separate structure, as is shown in the drawings, or can be an integral part of the lug 20). When the pin escutcheons 10 engage the electrical contacts, a closed electric circuit is formed. This circuit can then act to signal an elevator controller that the hatchway door is locked.

Figure 4:
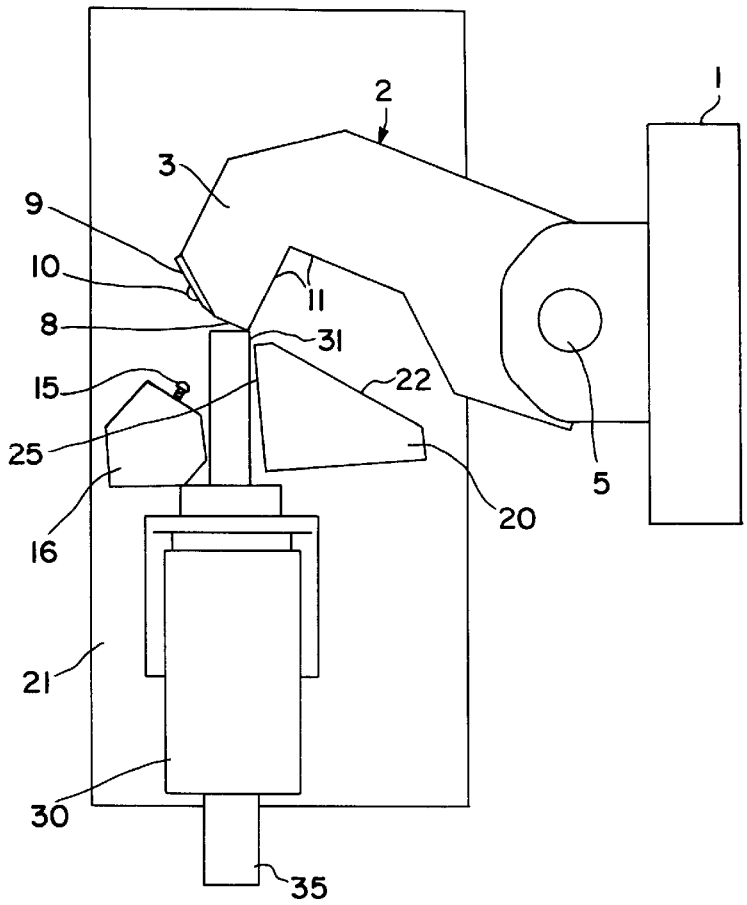
FIG. 4 depicts an electromechanical interlock according to the present invention wherein the interlock is in an unlocked position.
Figure 5:
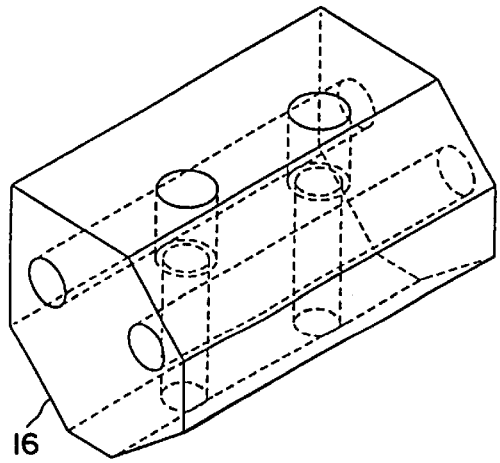
FIG. 5 depicts a perspective view of a portion of an electrical contact assembly for use with the present invention.

A solenoid 30, or other electromechanical device, is mounted beneath and between the lug 20 and the electrical contact assembly 16. The solenoid has an extendable pin 31 for engaging the outboard surface 8 of the beak end 3 when the solenoid 30 is energized and for pivoting the pivotal hook 2 (clockwise in FIG. 3) to an unlocked position. As shown in FIG. 4 the pivotal hook pivots to a point where the inboard surface 11 will not engage the locking surface 25 of the lug 20 when the hatchway door is opened. The solenoid 30 may also have a manual release mechanism 35 for unlocking the interlock in the event of a power failure or other malfunction. The manual release mechanism 35 may comprise a push button assembly for manually extending the solenoid pin 31 so that the hook may be pivoted manually to the unlocked position.

Figure 6:
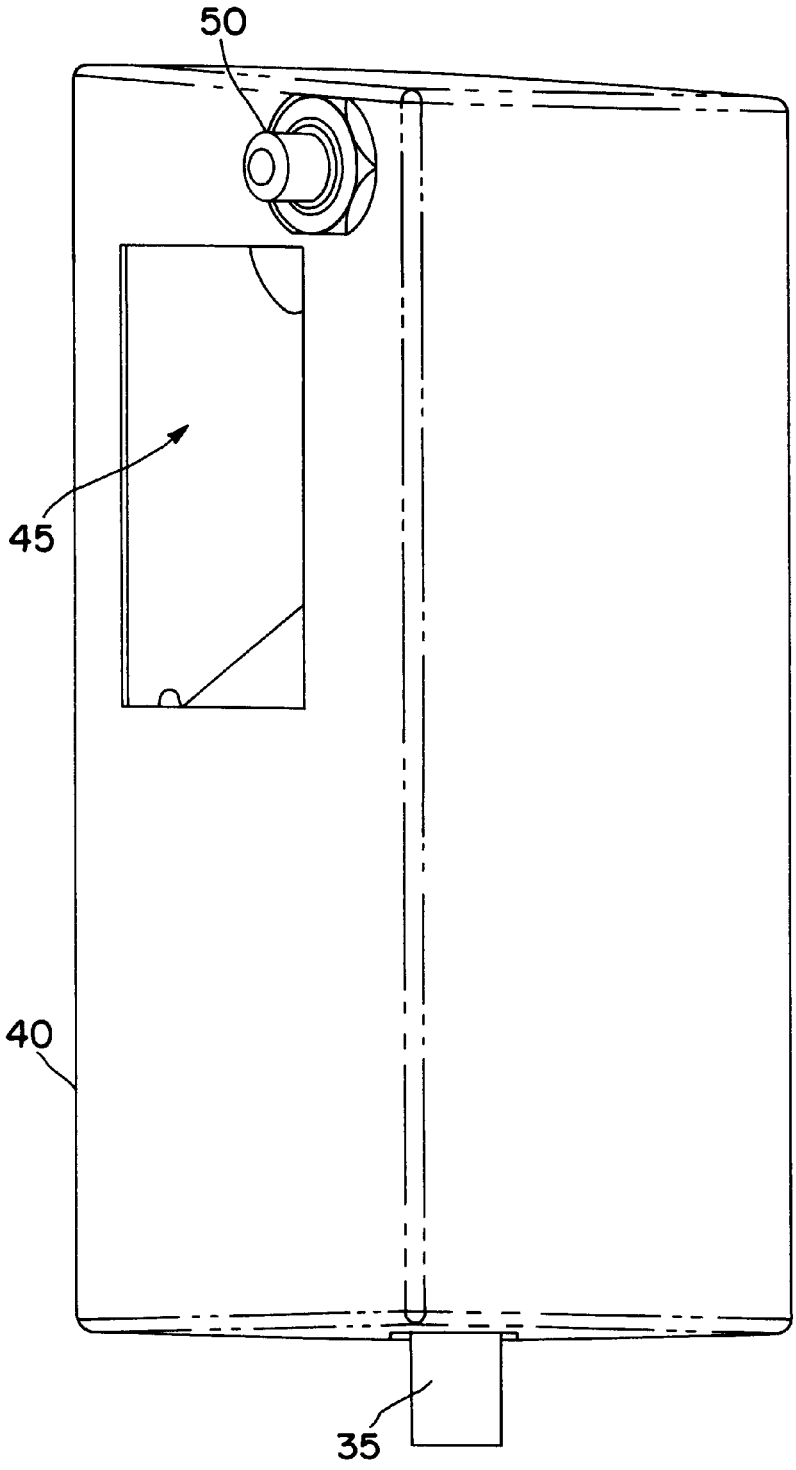
FIG. 6 depicts a fire resistant box for housing some of the components of the present invention.

The pivotal hook 2 may be mounted to a swinging elevator door via a bracket 1 and the lug 20, electrical contact assembly 16, and solenoid 30 may be mounted to a mounting plate 21 that is in turn mounted to a door jamb or other suitable structure associated with the elevator hoistway. As is shown in FIG. 6, the plate 21 containing the lug 20, electrical contact assembly 15, and solenoid 30 may be enclosed in a fire resistant box 40. The fire resistant box 40 preferably contains an opening 45 through which the beak end 3 protrudes when the interlock is in a locked position. A contact switch 50 may also be mounted to a surface on the fire resistant box. The contact switch 50 contacts the hatchway door and provide a means for determining when the hatchway door is closed.

In some embodiments it may be desirable to mount the hook to a doorjamb or other suitable hatchway structure and the other components to the hatchway door. Moreover, the present invention may be readily modified for use with sliding hatchway doors. In addition, the invention may be modified for use on an elevator cab door as well as a hatchway door.

The hook may be manufactured from a conducting material and thus the outer surface of the beak end is itself the conductor. While the lug is shown having an inclined surface, not all embodiments require an inclined surface. However, in some embodiments it may be desirable to match the incline angle of the inclined surface of the lug with the angle formed by one or more outboard surfaces on the beak end that engages the lug when the door opens or closes. (See FIG. 4).

What is claimed is:

1. An elevator hatchway door interlock for a swinging elevator hatchway door that swings between an opened and closed position, the interlock comprising:

a pivotal hook disposed on the elevator hatchway door, and biased by a coiled spring to rotate from an unlocked position to a locked position, the pivotal hook having a beak end and a fulcrum end, the beak end having an electrical conductor disposed thereon, a mounting plate for being mounted in an elevator hoistway, the mounting plate having:

(i) a lug having an inclined surface for slidably engaging the beak end when the door swings from the open position to the closed position, the lug also having a locking surface for engaging the beak end when the door is in the closed position and the hook is in the locked position, thereby preventing the door from being opened;

(ii) a contact assembly mounted alongside the lug and having electrical contacts disposed thereon that engage the electrical conductor when the hook is in the locked position and the door is in the closed position, thereby closing an electrical circuit only when the hook is in the locked position; and (iii) a solenoid mounted below the lug and contact assembly, and having an extendable pin for engaging the hook, the solenoid having a retracted position wherein the extendable pin is retracted, the solenoid having an extended position wherein the extendable pin is extended up from the solenoid between the lug and contact assembly, and engages a lower surface of the beak end of the hook to pivot it to the unlocked position.

2. The interlock of claim 1, further comprising pin escutcheons disposed on the electrical conductor.

3. The interlock of claim 2, wherein the pin escutcheons are a brass alloy.

4. The interlock of claim 1, wherein the pivotal hook is manufactured from a phenolic plastic.

5. The interlock of claim 1, further comprising a manual release means for manually pivoting the pivotal hook to the unlocked position.

6. An electromechanically interlocked swinging elevator hatchway door comprising:

a swinging door having an interior and exterior surface, the interior surface facing toward the hoistway and the exterior surface facing an opposite direction;

a pivotal book pivotally mounted on the interior surface of the hatchway door, the hook pivoting between a locked and unlocked position, the hook being biased by a coiled spring toward the locked position, the hook also having a beak end, the beak end having an electrical conductor disposed thereon;

a lug for being mounted in an elevator hoistway, the lug having a locking surface for engaging the beak end of the pivot hook when the door is in a closed position;

an electrical contact assembly located alongside the lug for being mounted in the elevator hoistway, the electrical contact assembly having electrical contacts for engaging the electrical conductor; and a solenoid for being mounted in the elevator hoistway, the solenoid located below the lug and contact assembly, and having an extendable pin that moves up between the lug and the contact assembly to engage and pivot the hook to the unlocked position where the beak does not engage the lug.

7. The electromechanically interlocked swinging hatchway door of claim 6, wherein the pivotal hook is manufactured from a phenolic plastic.

8. The electromechanically interlocked swinging hatchway door of claim 7, further comprising pin escutcheons disposed on the electrical conductor for engaging the electrical contacts.

9. The electromechanically interlocked swinging hatchway door of claim 6, further comprising a manual release mechanism.

10. An electromechanical interlock for a swinging elevator door that swings between an open position and a closed position, the interlock comprising:

a pivotal hook having a beak end, the pivotal hook disposed on the swinging elevator door, the hook also being biased by a coiled spring to pivot from a locked position to an unlocked position;

an electrical conductor disposed on the beak end;

a solenoid having an extendable pin tint moves between a retracted and an extended position, when in the extended position the extendable pin contacting the hook to rotate the hook to the first position;

a lug located above the solenoid and that contacts a portion of the beak end when the extendable pin is retracted; and an electrical contact located alongside the lug that electrically engages the electrical conductor when the door is in the closed position and the extendable pin is retracted, wherein in the extendable position, the pin of the solenoid moves upwards and between the lug and the electrical contact to move a lower surface of the beak end of the hook from the locked position to the unlocked position.

* * * * *

UNITED STATES PATENT AND TRADEMARK OFFICE

CERTIFICATE OF CORRECTION

PATENT NO. : 6,659,514 B2
DATED : December 9, 2003
INVENTOR(S) : Patrick Bass

It is certified that error appears in the above-identified patent and that said Letters Patent is hereby corrected as shown below:

Column 4,
Line 15, delete “book” and substitute therefor -- hook --.
Line 51, delete “tint” and substitute therefor -- that --.

Signed and Sealed this

Twenty-fourth Day of February, 2004

JON W. DUDAS
*Acting Director of the United States Patent and Trademark Office*